US012258949B2

(12) United States Patent
Yi et al.

(10) Patent No.: US 12,258,949 B2
(45) Date of Patent: Mar. 25, 2025

(54) TWO-STROKE PUMPING METHOD AND OIL PRODUCTION DEVICE

(71) Applicant: Yangtze University, Jingzhou (CN)

(72) Inventors: Xianzhong Yi, Jingzhou (CN); Shifan Zhang, Jingzhou (CN); Guangkun Xia, Jingzhou (CN); Xinbo Zhao, Jingzhou (CN); Jifang Wan, Jingzhou (CN); Yuanhua Zhou, Jingzhou (CN); Yanbin Wang, Jingzhou (CN); Yangchuan Ke, Jingzhou (CN); Binbin Diao, Jingzhou (CN); Peng Jia, Jingzhou (CN); Jun Fang, Jingzhou (CN)

(73) Assignee: Yangtze University, Jingzhou (CN)

( * ) Notice: Subject to any disclaimer, the term of this patent is extended or adjusted under 35 U.S.C. 154(b) by 326 days.

(21) Appl. No.: 17/871,320

(22) Filed: Jul. 22, 2022

(65) Prior Publication Data

US 2023/0024940 A1 Jan. 26, 2023

(30) Foreign Application Priority Data

Jul. 23, 2021 (CN) ..... 202110833525.3

(51) Int. Cl.
*F04B 15/02* (2006.01)
*F04B 19/22* (2006.01)
*F04B 53/10* (2006.01)

(52) U.S. Cl.
CPC ..... *F04B 15/02* (2013.01); *F04B 19/22* (2013.01); *F04B 53/10* (2013.01)

(58) Field of Classification Search
CPC ..... F04B 15/02; F04B 19/22; F04B 53/10; F04B 53/1075; F04B 53/1087;
(Continued)

(56) References Cited

U.S. PATENT DOCUMENTS 3,376,935 A * 4/1968 Baker ..... E21B 21/10 166/325
3,479,958 A * 11/1969 Anderson ..... F04B 47/00 417/448
5,429,193 A * 7/1995 Hegebarth ..... F04B 53/005 417/454

FOREIGN PATENT DOCUMENTS

CN 2489114 Y * 3/2012
CN 103306953 A * 9/2013

OTHER PUBLICATIONS

CN2489114Y, Machine translation of CN-103306953-A (Year: 2012).*
CN103306953AMT, Machine translation of CN-2489114-Y (Year: 2013).*

* cited by examiner

*Primary Examiner* — Dominick L Plakkoottam
*Assistant Examiner* — Charles W Nichols
(74) *Attorney, Agent, or Firm* — Stanek Lemon Crouse & Meeks PA

(57) ABSTRACT

The present disclosure provides a two-stroke pumping method and oil production device, and relates to the technical field of oil production. The oil production device comprises a pump body, wherein the oil production device further comprises a central tube of a hollow structure, and the central tube is partially located in the pump body and coaxially arranged with the pump body; a traveling valve and a standing valve are arranged on the left side and the right side of the outer wall of the central tube respectively, and the traveling valve is arranged between the pump body and the central tube; the standing valve is located outside the pump body; the traveling valve and the standing valve are matched with the pump body and the central tube to form an oil pumping space; and an oil pumping assembly is further arranged in the oil pumping space.

7 Claims, 2 Drawing Sheets

(58) Field of Classification Search
CPC ..... F04B 53/12; F04B 53/121; F04B 53/122;
F04B 53/125; F04B 53/128
See application file for complete search history.

TWO-STROKE PUMPING METHOD AND OIL PRODUCTION DEVICE

CROSS-REFERENCE TO RELATED APPLICATION

This patent application claims the benefit and priority of Chinese Patent Application No. 202110833525.3, filed on Jul. 23, 2021, the disclosure of which is incorporated by reference herein in its entirety as part of the present application.

TECHNICAL FIELD

The present disclosure relates to the technical field of oil production, and specifically relates to a two-stroke pumping method and oil production device.

BACKGROUND ART

At present, most oil production devices in the world drive plungers to reciprocate up and down by adopting sucker rods, so that crude oil is produced. An existing oil production device is composed of an upper joint, a pump body, a plunger, a traveling valve, a standing valve, a valve seat and the like. The sucker rod passes through a central hole of the upper joint and is connected with the plunger.

The existing oil production device can meet the oil production requirements under normal conditions. However, if oil testing of an oil well with a pump or testing of an oil production profile of an oil layer with a pump is required, the existing oil production device cannot complete oil testing or test of the oil production condition of an oil layer production surface. The plunger, the traveling valve and the standing valve of the existing oil production device are all of solid structures, so that the requirement of carrying a measuring instrument cannot be met. Therefore, it is impossible for any instrument to reach a predetermined downhole position through the plunger and corresponding accessories to perform testing.

Thus, the problem that structural engineers need to overcome at present is to change the structure of a traditional oil well pump, especially to design an oil pump structure capable of conveniently using a measuring instrument to measure the oil layer production surface.

SUMMARY

Aiming at the problems in the prior art, the present disclosure provides a novel technical scheme, and a brand new oil production device structure is designed, so that an operator can synchronously measure and test the oil production condition of an oil layer production surface by utilizing a measuring instrument during oil pumping operation; and the data acquisition accuracy is further improved.

The specific scheme proposed by the present disclosure is as follows.

A two-stroke pumping oil production device comprises a pump body, wherein the oil production device further comprises a central tube of a hollow structure, and the central tube is partially located in the pump body and coaxially arranged with the pump body;

a traveling valve and a standing valve are arranged on the left side and the right side of the outer wall of the central tube respectively, and the traveling valve is arranged between the pump body and the central tube; the standing valve is located outside the pump body;

the traveling valve and the standing valve are matched with the pump body and the central tube to form an oil pumping space; an oil pumping assembly is further arranged in the oil pumping space, and the oil pumping assembly axially moves in the oil pumping space in a reciprocating mode so that the traveling valve and the standing valve can be opened step by step to achieve oil pumping.

Further, a bushing is arranged on the inner wall of the pump body, and the traveling valve and the oil pumping assembly are arranged between the bushing and the central tube.

Further, the traveling valve comprises a traveling valve cover and a traveling valve core, the traveling valve cover is fixed on the bushing, and the traveling valve cover is provided with a first stop ring and a first protrusion in the direction facing the central tube;

an oil hole is formed in the first stop ring, and the first stop ring and the first protrusion are arranged at intervals to form a first interval space;

the traveling valve core is fixed to the outer wall of the central tube and located in the first interval space; and the traveling valve core can move in the first interval space and can be in sealing contact with the first protrusion.

Further, the oil pumping assembly comprises a plunger fixed on the bushing and one end of the plunger is fixed on the traveling valve cover in threaded connection; the plunger is provided with a trapezoidal protrusion in the direction facing the central tube;

the oil pumping assembly further comprises a first push block and a second push block which are fixed on the central tube, the first push block is located on the left side of the trapezoidal protrusion, and an oil hole is formed in the first push hole; the second push block is located on the right side of the trapezoidal protrusion;

due to the movement of the central tube from left to right, the first push block and the second push block are in sealing contact with the bevel edge of the trapezoidal protrusion respectively.

Further, stop nuts are arranged on the left side of the first push block and the right side of the second push block respectively; and the stop nuts are fixed on the central tube.

Further, the standing valve comprises a standing valve cover, a standing valve core, a spring and a standing valve baffle; the standing valve core and the spring sleeve the central tube; the standing valve baffle comprises a second stop ring and a connecting ring, the second stop ring is in cup-joint contact with the central tube, an oil hole is formed in the second stop ring, and the connecting ring is fixed with the standing valve cover through a cylindrical pin; the spring is located between the second stop ring and the standing valve core; and the standing valve cover is provided with a second protrusion in the direction facing the central tube, and the standing valve core can be in sealing contact with the second protrusion under the action of the spring.

Further, the standing valve cover is connected with the pump body through an extension coupling.

Further, a pump barrel joint is further arranged at the leftmost end of the pump body, and the pump barrel joint is fixedly connected with the pump body through threads.

Through the adoption of the technical scheme, the beneficial effects are as follows.

Through the brand-new design of the structure of the oil production device, the central tube of a hollow structure is arranged in the pump body, so that a measuring instrument can enter the oil layer production surface through the central tube to carry out measurement; the data acquisition accuracy of workers is improved; and meanwhile, by designing the brand-new oil production device structure, oil pumping can be smoothly carried out while measurement is completed.

The present scheme specifically introduces a using method of the pumping oil production device, and the using method comprises the following steps:

step one, resetting:

adjusting the oil production device, so that the traveling valve core in the oil production device is in sealing contact with the first protrusion, the first push block is in sealing contact with the trapezoidal protrusion, and the standing valve core is in sealing contact with the second protrusion;

step two, pump embedding:

immersing at least the standing valve of the oil pump in the oil; placing an oil layer oil production measurer in the central tube;

step three, oil feeding:

pumping the central tube leftwards so that the traveling valve core and the first protrusion are released from a sealing state and move leftwards, separating the first push block from the trapezoidal protrusion to move leftwards so that the pressure intensity in the oil pumping space is reduced, extruding the standing valve core under the action of the pressure intensity through the oil on the right, and moving the standing valve core leftwards so that the standing valve core is separated from the second protrusion to form an oil inlet; enabling the oil to enter the oil pumping space through the oil hole of the second stop ring;

step four, secondary oil pumping:

pumping the central tube rightwards, so that cooperation of components in the oil production device is in the reset state of the first step; and at the moment, enabling most oil in the oil pumping space to flow between the first push block and the traveling valve core;

step five, oil discharging:

pumping the central tube leftwards, and at the moment, enabling the oil located between the first push block and the traveling valve core to overflow from the oil outlet hole of the first stop ring under the pushing action of the first push block; and at the moment, reducing the pressure intensity of the whole oil pumping space again, and in the state of the third step, pressurizing the standing valve core under the action of the pressure intensity so that the oil inlet hole is opened; and continuously repeating the steps to complete the pumping of the oil.

By introducing the using method, the operator can conveniently and correctly use the device.

Reference signs: 10, pump body; 11, bushing; 20, central tube; 30, traveling valve; 31, traveling valve cover; 32, traveling valve core; 40, oil pumping assembly; 41, plunger; 42, trapezoidal protrusion; 43, first push block; 44, second push block; 45, stop nut; 50, standing valve; 51, standing valve cover; 52, standing valve core; 53, spring; 54, standing valve baffle; 60, extension coupling; 70, pump barrel joint; 311, first stop ring; 312, first protrusion; 511, second protrusion; 541, second stop ring; and 542, connecting ring.

DETAILED DESCRIPTION OF THE EMBODIMENTS

The principles and features of the present disclosure are introduced in detail in combination with the following attached figures, the examples are only intended to describe the present disclosure, but not intended to limit the scope of the present disclosure.

The embodiment provides a pumping oil production device. Through the brand-new design of the structure of the oil production device, the oil production device can achieve oil pumping and oil production, and also can be matched with a measuring and detecting instrument to achieve oil production testing of an oil layer production surface.

The specific structure of the oil production device is described in detail as follows.

Figure 1:
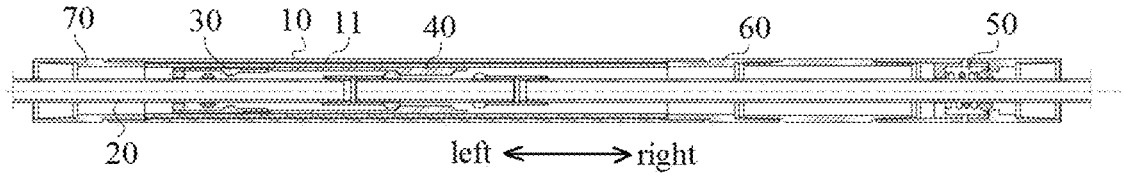
FIG. 1 is an overall sectional structure diagram of a pumping oil production device.
Figure 2:
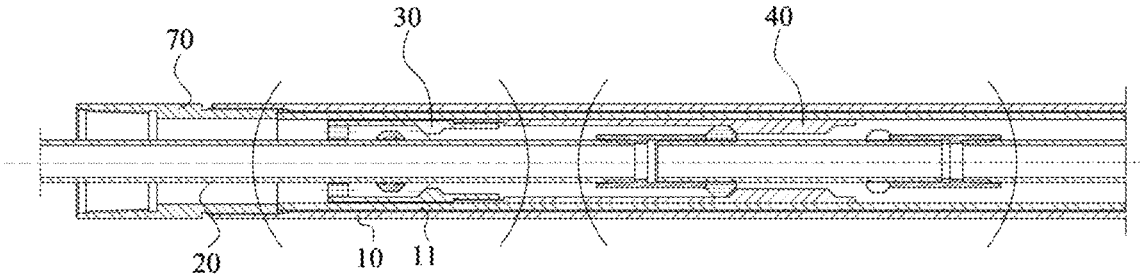
FIG. 2 is a part sectioned view of a traveling valve and an oil pumping assembly on the left side in the oil production device.
Figure 5:
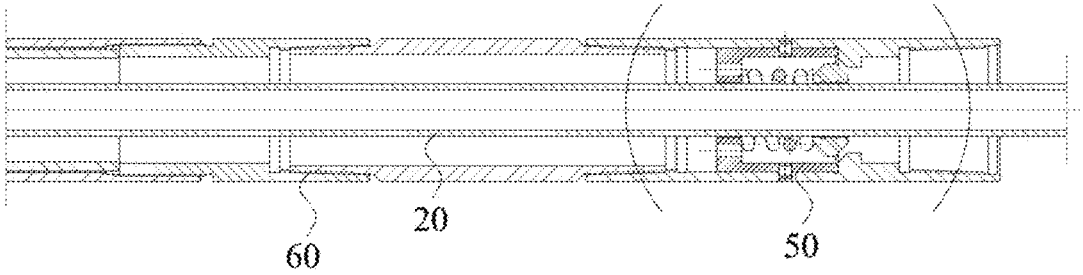
FIG. 5 is a part sectioned view of a standing valve on the right side in the oil production device.

Referring to FIG. 1, FIG. 2 and FIG. 5, the pumping oil production device provided by the scheme comprises a pump body 10, and the pump body 10 is arranged on the periphery and can play an effective protection role. The oil production device further comprises a central tube 20 of a hollow structure, and the central tube is partially located in the pump body 10 and coaxially arranged with the pump body 10. It can be understood that one end of the central tube 20 is arranged inside the pump body 10 and the other end of the central tube is located outside the pump body 10. A traveling valve 30 and a standing valve 50 are arranged on the left side and the right side of the outer wall of the central tube 20 respectively, and the traveling valve 30 is arranged between the pump body 10 and the central tube 20. The standing valve 50 is located outside the pump body 10.

Namely, in the embodiment, the traveling valve 30 is arranged between the pump body 10 and the central tube 20, and the standing valve 50 is arranged at the other end of the central tube 20. It is noted that the pump body 10 does not extend to the standing valve 50. It can be understood that the traveling valve 30 provided in the present scheme is arranged in the direction close to the left side of the central tube 20, and the standing valve 50 is arranged in the direction close to the right side of the central tube 20.

Through the arrangement, the traveling valve 30 and the standing valve 50 are matched with the pump body 10 and the central tube 20 to form an oil pumping space, and the oil pumping space is mainly used for pumping and transition flow of oil. Namely, the oil is pumped through the oil production device, enters the oil pumping space from the right side, and then overflows from the left side of the oil production device through transition of the oil pumping space. It should be noted that left and right directions referred to herein are defined for ease of understanding according to the orientation of the oil production device in the attached figures. Namely, the oil outlet end is in the left direction, and the oil inlet end is in the right direction; a user can define the oil outlet end and the oil inlet end in different placement directions.

In the embodiment, transition flow of oil in the oil pumping space is achieved through the oil pumping assembly 40. Namely, the oil pumping assembly 40 is further arranged in the oil pumping space, and the oil pumping assembly 40 axially moves in the oil pumping space in a reciprocating mode so that the traveling valve 30 and the standing valve 50 can be opened step by step to achieve oil pumping.

In the specific using process, the oil production device is put in the oil, and it is guaranteed that the standing valve 50 can be immersed in the oil. Then, the oil layer oil production measurer is put in through the central pipe 20 and used for testing the oil production of the oil layer production surface. Meanwhile, the central tube 20 is pumped in a reciprocating mode, so that the oil pumping assembly 40 in the central tube 20 axially moves in a reciprocating mode in the oil pumping space, and the traveling valve 30 and the standing valve 50 are promoted to be opened step by step, so that the oil can enter the oil pumping space through the oil inlet end and then overflows through the oil outlet end.

Optionally, a bushing 11 is arranged on the inner wall of the pump body 10, and the traveling valve 30 and the oil pumping assembly 40 are arranged between the bushing 11 and the central tube 20. Effective protection of the traveling valve 30 and the oil pumping assembly 40 is formed by using the bushing 11, and the sealing effect of the whole oil pumping space is further promoted.

The specific composition of the traveling valve 30, the oil pumping assembly 40 and the standing valve 50 is described in detail as follows.

Figure 3:
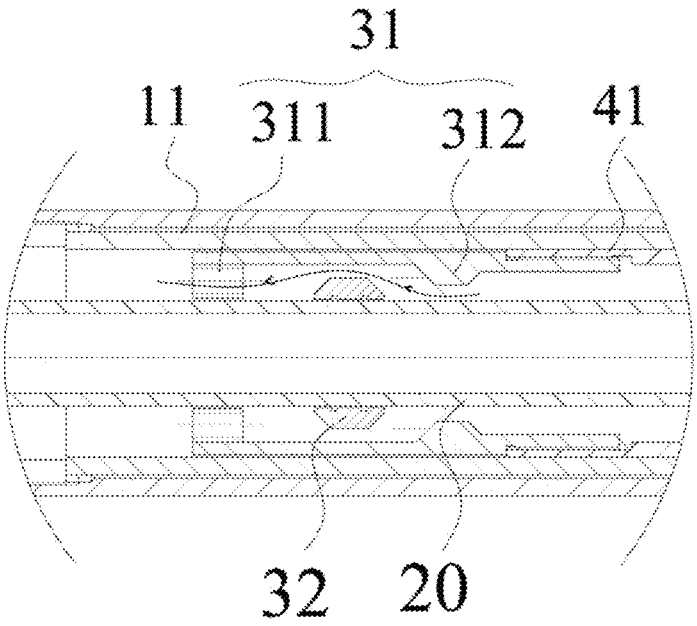
FIG. 3 is an enlarged drawing of the traveling valve in FIG. 2.

In the embodiment, referring to FIG. 3, the traveling valve 30 comprises a traveling valve cover 31 and a traveling valve core 32, wherein the traveling valve cover 31 is fixed on the bushing 11, and the traveling valve cover 31 is provided with a first stop ring 311 and a first protrusion 312 in the direction facing the central tube 20. An oil hole is formed in the first stop ring 311, and the first stop ring 311 and the first protrusion 312 are arranged at intervals to form a first interval space. The traveling valve core 32 is fixed to the outer wall of the central tube 20 and located in the first interval space. The traveling valve core 32 can move in the first interval space and can be in sealing contact with the first protrusion 312.

It can be understood that when the central tube 20 moves, the movement of the traveling valve core 32 cam be controlled. Namely, the central tube 20 moves rightwards so that the traveling valve core 32 is in sealing contact with the first protrusion 312. At the moment, the oil hole of the first stop ring 311 and the oil pumping space are blocked, namely, the oil outlet end is closed. When the central tube 20 moves leftwards so that the traveling valve core 32 is separated from the first protrusion 312, the oil hole of the first stop ring 311 communicates with the oil pumping space, namely, the oil outlet end is opened. (The direction of an arrow lead in the figure is the flow direction of the oil after the oil outlet end is opened).

Figure 4:
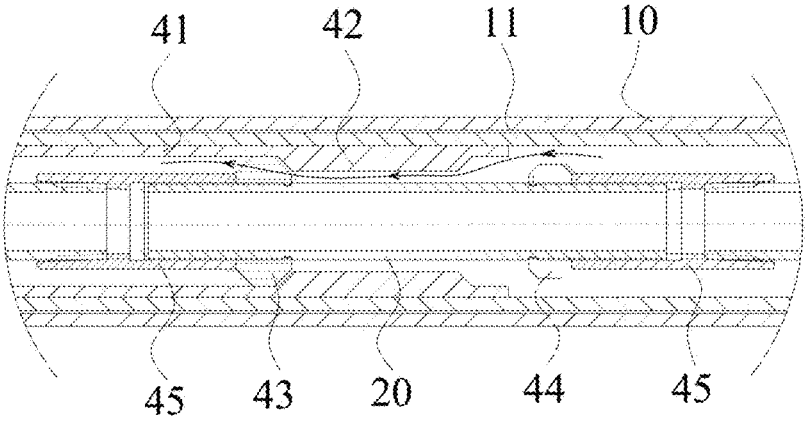
FIG. 4 is an enlarged drawing of the oil pumping assembly in FIG. 2.

In the embodiment, referring to FIG. 4, the oil pumping assembly 40 comprises a plunger 41 fixed on the bushing 11, and one end of the plunger 41 is fixed on the traveling valve cover 31 in threaded connection. The plunger 41 is provided with a trapezoidal protrusion 42 in the direction facing the central tube 20. The oil pumping assembly 40 further comprises a first push block 43 and a second push block 44 which are fixed on the central tube 20, the first push block 43 is located on the left side of the trapezoidal protrusion 42, and an oil hole is formed in the first push hole 43. The second push block 44 is located on the right side of the trapezoidal protrusion 42.

At the moment, due to the movement of the central tube 20 from left to right, the first push block 43 and the second push block 44 synchronously move. For example, when the central tube 20 moves rightwards, the first push block 43 is in sealing contact with the bevel edge of the trapezoidal protrusion 42, and the second push block 44 is in a separated state; and when the central tube 20 moves leftwards, the second push block 44 is in sealing contact with the bevel edge of the trapezoidal protrusion 42, and the first push block 43 is in a separated state.

Through the arrangement, oil is promoted to flow from right to left in the oil pumping space mainly through disturbance of the first push block 43 and the second push block 44 in the oil pumping space, and the oil in the oil pumping space can flow in the direction along the second push block 44 to the first push block 43 due to the movement of the central tube 20 from left to right, namely, the oil flows towards the oil outlet end (the oil hole of the first stop ring 311). The arrow direction in the figure is the flow direction of oil.

Optionally, stop nuts 45 are arranged on the left side of the first push block 43 and the right side of the second push block 44 respectively. The stop nuts 45 are fixed on the central tube 20. The stop nuts 45 are mainly used for positioning, and the situation that the first push block 43 and the second push block 44 are staggered in the back-and-forth abutting sealing process with the bevel edge of the trapezoidal protrusion 42 is avoided.

Figure 6:
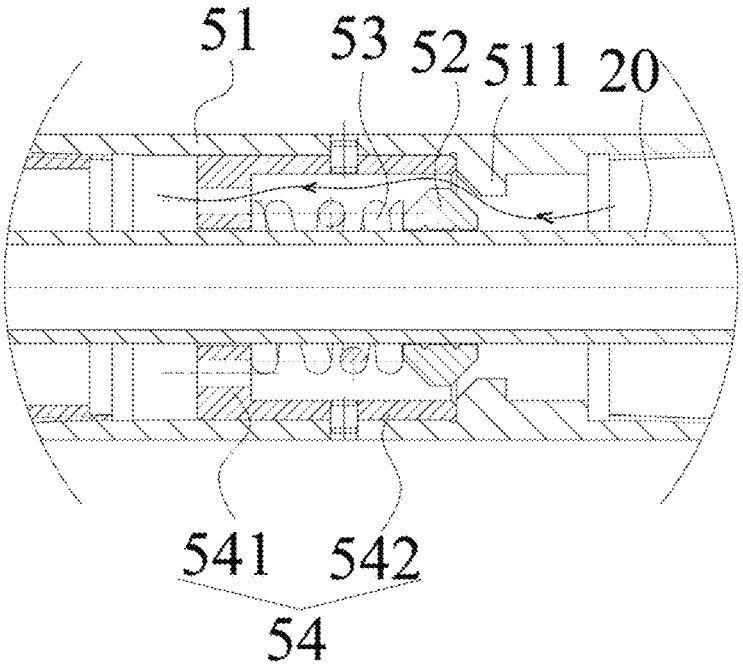
FIG. 6 is an enlarged drawing of the standing valve in FIG. 5.

In the embodiment, referring to FIG. 6, the standing valve 50 comprises a standing valve cover 51, a standing valve core 52, a spring 53 and a standing valve baffle 54. The standing valve core 52 and the spring 53 sleeve the central tube 20. The standing valve baffle 54 comprises a second stop ring 541 and a connecting ring 542, the second stop ring 541 is in cup-joint contact with the central tube 20, an oil hole is formed in the second stop ring 541, and the connecting ring 542 is fixed with the standing valve cover 51 through a cylindrical pin. The spring 53 is located between the second stop ring 541 and the standing valve core 52. The standing valve cover 51 is provided with a second protrusion 511 in the direction facing the central tube 20, and the standing valve core 52 can be in sealing contact with the second protrusion 511 under the action of the spring 53.

It can be understood that the standing valve core 52, the spring 53 and the standing valve baffle 54 are arranged on the right side of the central tube 20 by utilizing the standing valve cover 51, and the standing valve 52 is elastically connected with the second stop ring 541 through the spring 53; and under the action of the spring 53, the spring 53 abuts against the second protrusion 511 in a sealing mode.

The cooperation of the standing valve core 52 and the second protrusion 511 is equivalent to the oil inlet end. Specifically, when the spring 53 is compressed (the spring 53 is in a compressed state in the figure), the standing valve core 52 and the second protrusion 511 are separated to form an oil inlet, and the oil enters the oil pumping space through the oil inlet (the arrow direction in the figure is the oil inlet direction of the oil). When the spring 53 resets, the standing valve core 52 abuts against the second protrusion 511 in a sealing mode so that the oil inlet end is closed.

Optionally, the standing valve cover 51 is connected with the pump body 10 through an extension coupling 60.

Optionally, a pump barrel joint 70 is further arranged at the leftmost end of the pump body 10, and the pump barrel joint 70 is fixedly connected with the pump body 10 through threads.

Therefore, referring to FIG. 1, the two-stroke pumping oil production device comprises the following specific using steps:

step one, resetting:

adjusting the oil production device, so that the traveling valve core 32 in the oil production device is in sealing contact with the first protrusion 312, the first push block 43 is in sealing contact with the trapezoidal protrusion 42, and the standing valve core 52 is in sealing contact with the second protrusion 511;

step two, pump embedding (placement of the oil production device in the oil):

immersing at least the standing valve 50 of the oil pump in the oil; placing an oil layer oil production measurer in the central tube 20;

step three, oil feeding:

pumping the central tube 20 leftwards so that the traveling valve core 32 and the first protrusion 312 are released from a sealing state and move leftwards, separating the first push block 43 from the trapezoidal protrusion 42 to move leftwards so that the pressure intensity in the oil pumping space is reduced, extruding the standing valve core 52 under the action of the pressure intensity through the oil on the right, and moving the standing valve core 52 leftwards and compressing the spring 53 so that the standing valve core 52 is separated from the second protrusion 511 to form an oil inlet; enabling the oil to enter through the oil inlet and enter the oil pumping space through the oil hole of the second stop ring 541 until the pressure intensity of the oil pumping space is balanced with the exterior, and gradually presetting the spring 53 to promote the standing valve core 52 to move rightwards and be sealed with the second protrusion 511 to plug the oil inlet;

step four, secondary oil pumping:

pumping the central tube 20 rightwards, so that cooperation of components in the oil production device is in the reset state of the first step; and at the moment, enabling most oil in the oil pumping space to flow in the direction along the second push block 44 to the first push block 43 and flow between the first push block 43 and the traveling valve core 32 under the disturbance of the push blocks (the second push block 44 to the first push block);

step five, oil discharging:

pumping the central tube leftwards, and at the moment, enabling the oil located between the first push block 43 and the traveling valve core 32 to overflow from the oil outlet hole of the first stop ring 311 under the pushing action of the first push block 43; and at the moment, reducing the pressure intensity of the whole oil pumping space again, and in the state of the third step, pressurizing the standing valve core 52 under the action of the pressure intensity so that the oil inlet hole is opened to realize the incoming of the oil; and continuously repeating the steps to complete the pumping of the oil.

The foregoing descriptions are merely exemplary embodiments of the present disclosure, but are not intended to limit the present disclosure. Any modification, equivalent replacement, or improvement made within the spirit and principle of the present disclosure shall fall within the protection scope of the present disclosure.

What is claimed is:

1. A two-stroke pumping oil production device, comprising a pump body, wherein the oil production device further comprises:

a central tube of a hollow structure, and the central tube is partially located in the pump body and coaxially arranged with the pump body;

a traveling valve and a standing valve are arranged on a first side and a second side of the outer wall of the central tube respectively, and the traveling valve is arranged between the pump body and the central tube; the standing valve is located outside the pump body;

the traveling valve and the standing valve are matched with the pump body and the central tube to form an oil pumping space; an oil pumping assembly is further arranged in the oil pumping space, and the oil pumping assembly axially moves in the oil pumping space in a reciprocating mode so that the traveling valve and the standing valve can be opened step by step to achieve oil pumping;

wherein a bushing is arranged on the inner wall of the pump body, and the traveling valve and the oil pumping assembly are arranged between the bushing and the central tube;

wherein the traveling valve comprises a traveling valve cover and a traveling valve core, the traveling valve cover is fixed on the bushing, and the traveling valve cover is provided with a first stop ring and a first protrusion in a direction facing the central tube;

an oil hole is formed in the first stop ring, and the first stop ring and the first protrusion are arranged at intervals to form a first interval space;

the traveling valve core is fixed to the outer wall of the central tube and located in the first interval space; and the traveling valve core can move in the first interval space and can be in sealing contact with the first protrusion; and wherein the oil pumping assembly comprises a plunger fixed on the bushing and one end of the plunger is fixed on the traveling valve cover in threaded connection; the plunger is provided with a trapezoidal protrusion in the direction facing the central tube;

the oil pumping assembly further comprises a first push block and a second push block which are fixed on the central tube, the first push block is located on the first side of the trapezoidal protrusion, and an oil hole is formed in the first push block; the second push block is located on the second side of the trapezoidal protrusion;

due to the movement of the central tube in a first direction, the first push block and the second push block are in sealing contact with a bevel edge of the trapezoidal protrusion respectively.

2. The two-stroke pumping oil production device of claim 1, wherein stop nuts are arranged on the first side of the first push block and the second side of the second push block respectively; and the stop nuts are fixed on the central tube.

3. The two-stroke pumping oil production device of claim 2, wherein the standing valve comprises a standing valve cover, a standing valve core, a spring and a standing valve baffle; the standing valve core and the spring sleeve the central tube; the standing valve baffle comprises a second stop ring and a connecting ring, the second stop ring is in cup-joint contact with the central tube, an oil hole is formed in the second stop ring, and the connecting ring is fixed with the standing valve cover through a cylindrical pin; the spring is located between the second stop ring and the standing valve core; and the standing valve cover is provided with a second protrusion in the direction facing the central tube, and the standing valve core can be in sealing contact with the second protrusion under the action of the spring.

4. The two-stroke pumping oil production device of claim 3, wherein the standing valve cover is connected with the pump body through an extension coupling.

5. The two-stroke pumping oil production device of claim 3, wherein a pump barrel joint is further arranged at a first end of the pump body, and the pump barrel joint is fixedly connected with the pump body through threads.

6. A two-stroke pumping method, wherein pumping is carried out by using the pumping oil production device according to claim 3, wherein the method comprises:

step one, resetting:

adjusting the oil production device, so that the traveling valve core in the oil production device is in sealing contact with the first protrusion, the first push block is in sealing contact with the trapezoidal protrusion, and the standing valve core is in sealing contact with the second protrusion;

step two, pump embedding:

immersing at least the standing valve of the oil pump in the oil; placing an oil layer oil production measurer in the central tube;

step three, oil feeding:

pumping the central tube in a second direction so that the traveling valve core and the first protrusion are released from a sealing state and move in the second direction, separating the first push block from the trapezoidal protrusion to move in the second direction so that the pressure intensity in the oil pumping space is reduced, extruding the standing valve core under the action of the pressure intensity through the oil on the right, and moving the standing valve core in the second direction so that the standing valve core is separated from the second protrusion to form an oil inlet; enabling the oil to enter the oil pumping space through the oil hole of the second stop ring;

step four, secondary oil pumping:

pumping the central tube in a first direction, so that cooperation of components in the oil production device is in the reset state of the first step; and at the moment, enabling most oil in the oil pumping space to flow between the first push block and the traveling valve core;

step five, oil discharging:

pumping the central tube in the second direction, and at the moment, enabling the oil located between the first push block and the traveling valve core to overflow from the oil outlet hole of the first stop ring under the pushing action of the first push block; and at the moment, reducing the pressure intensity of the whole oil pumping space again, and in the state of the third step, pressurizing the standing valve core under the action of the pressure intensity so that the oil inlet is opened; and continuously repeating the steps to complete the pumping of the oil.

7. The two-stroke pumping method of claim 6, wherein the first direction is opposite the second direction.

* * * * *